United States Patent [19]

Land

[11] 4,140,254

[45] Feb. 20, 1979

[54] CANTEEN CONSTRUCTION

[76] Inventor: Elvert H. Land, 16205 E. Pawnee, Wichita, Kans. 67230

[21] Appl. No.: 813,975

[22] Filed: Jul. 8, 1977

[51] Int. Cl.[2] ..... A45C 1/04

[52] U.S. Cl. ..... 224/5 W; 220/67; 222/175

[58] Field of Search ..... 224/5 W, 47, 58, 55, 224/49, 45 C, 45 P; 220/73, 67, 10, 13, 94, 96; 190/59; 150/12; 222/175; 215/100 R

[56] References Cited

U.S. PATENT DOCUMENTS

| | | | |
|---|---|---|---|
| 231 | 1/1868 | Goune | 222/175 |
| 14,646 | 11/1885 | Bennett | 224/5 W |
| 361,718 | 4/1887 | Reinisch | 190/59 |
| 828,891 | 8/1906 | Krueger | 222/175 |
| 1,041,347 | 10/1912 | Potter | 220/10 |
| 1,051,558 | 1/1913 | Cornelius | 220/10 |
| 1,098,850 | 6/1914 | Steel | 220/10 |
| 1,907,884 | 5/1933 | Sexton | 220/10 |
| 2,196,486 | 4/1940 | Anderson | 220/10 |

FOREIGN PATENT DOCUMENTS

| | | | |
|---|---|---|---|
| 136457 | 11/1947 | Australia | 224/45 P |

*Primary Examiner*—Trygve M. Blix
*Assistant Examiner*—Kenneth W. Noland
*Attorney, Agent, or Firm*—Edward L. Brown, Jr.

[57] ABSTRACT

A composite construction of a cylindrical tank with fabric covered end panels surrounded by a sheet metal circular frame, the longitudinal edges of the frame are formed inwardly engaging the edges of the tank while the lateral edges of the frame form a lapping joint with the exposed lateral edge shaped with an inward radius. Formed in the frame are a plurality of carrying strap supports, each of which includes a pair of slots cut in the frame having rounded ends.

4 Claims, 7 Drawing Figures

CANTEEN CONSTRUCTION

BACKGROUND OF THE INVENTION

Cylindrical drum-shaped canteens having fabric end panels have been manufactured for many years. The end panels of the canteen are fabric covered to provide an evaporative surface for cooling the canteen or merely an insulative cover. The core of the canteen is a cylindrical plastic watertight container with a capped opening extending through the periphery of the tank. The relatively thin plastic tank is surrounded by a sheet metal frame which provides the basic rigidity to the tank along with a means for holding the overall structure together and carrying the supporting straps. The longitudinal edges of the metal frame are bent inwardly into contact with the circumferential edges of the tank and the cloth end panels covering the ends of the tank.

The sheet metal frame rolled from a planar strip is held together at its ends by a lap joint. The prior art method of forming this lateral joint, in all instances, exposes a sharp edge of the sheet metal which is usually not deburred and quite often creates a hazard for not only the people using the canteen but also the problem of abrading whatever it contacts. The prior art method of providing support loops in the frame for the carrying straps is done by first cutting two parallel slits and then deforming the area therebetween upwardly to create a pair of widened slots. This particular design is very abrasive upon support straps due to the sharp ends of the slits coming into a scissor contact with the fabric support straps which pass therebetween. The present invention utilizes, in place of the slits, a stamped slot having a rounded end so that the support strap cannot be abraded. Also, the frame member of the present invention has an overlapping lateral joint shaped so that when in place, there are no sharp edges along the joint to catch or abrade.

It is therefore the principal object of the present invention to provide an improved sheet metal frame on a conventional cylindrical canteen structure.

Another object of the present invention is to provide an improved canteen design which does not have to be individually deburred.

Another object of the invention is to provide an improved support strap loop formed in a sheet metal frame.

These and other objects of the invention will become apparent from a reading of the following specification and claims together with the accompanying drawings which set forth the preferred embodiment of the present invention:

Figure 1:
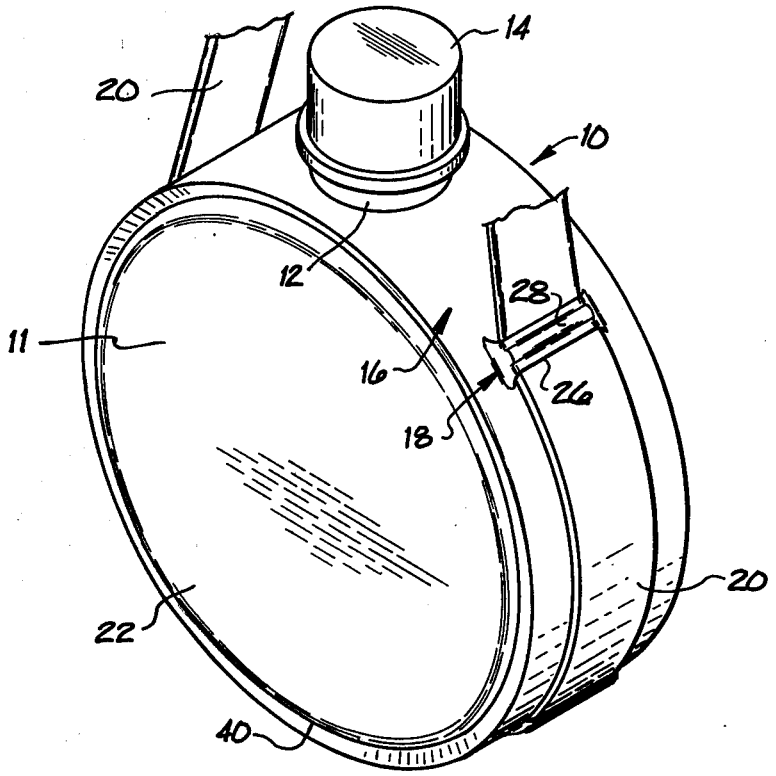
FIG. 1 is a perspective view of the overall canteen with a portion of the support strap broken away.
Figure 2:
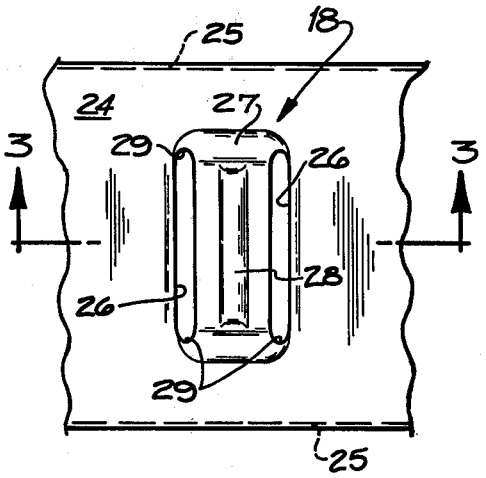
FIG. 2 is a partial plan view of the strap supporting loops with the remainder of the frame broken away.
Figure 3:
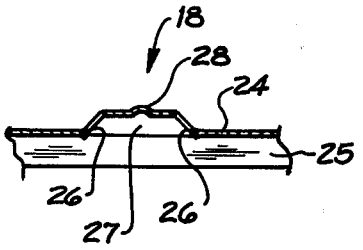
FIG. 3 is a fragmentary section taken along lines 3—3 of FIG. 2.
Figure 4:
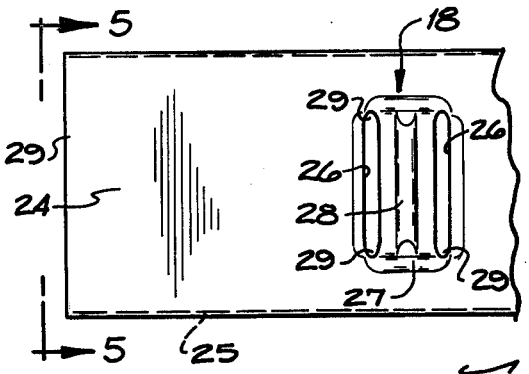
FIG. 4 is a plan view of the support frame before it is rolled into a circular shape with portions of the frame broken away to save space.
Figure 4:
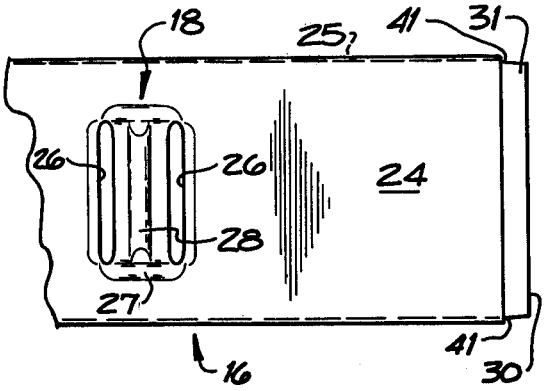
Figure 6:
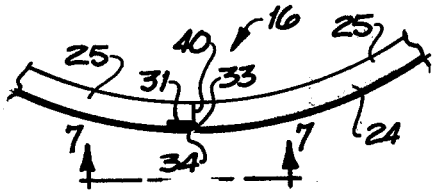
FIG. 6 is a fragmentary section of the end frame joint.

Referring now to the drawings, and more particularly to FIG. 1, the canteen structure is generally referred to by reference numeral 10. The canteen 10 includes a thin-walled cylindrical plastic tank 11 having a discharge outlet 12 covered by a removable cap 14. Surrounding the periphery of the tank is a sheet metal frame 16 having a plurality of support strap loops 18 positioned around the periphery thereof for receipt of a carrying strap 20. Covering the ends of the tank and held in place by the support frame are fabric panels 22 which act either as evaporative panels for cooling or insulation panels when dry. The sheet metal frame member 16 is roll-formed from a linear sheet 24 with a pair of flanges 25 along its longitudinal edge. The strap support loops 18 are formed in a two-stage operation. The first stage is stamping out the rounded end slots 26 while the second stage is die-forming the upwardly raised portion 27 between the slots 26 while downwardly bending the frame member along the outer edges of the slot, as shown in the drawing. The second stage includes a reinforcing rib 28 positioned between the slots 26 for increased strength. The frame member 16 in its linear shape, as shown in FIG. 4, is then passed through a roll-forming machine forming the frame into a circle with the lateral edges 29 and 30 forming an overlapping joint 40. Positioned adjacent edge 30 is an offset portion 31 which is best seen in FIG. 6, located inwardly from the plane of the frame. The offset portion 30 has tapered ends 35 with the flanges 25 removed for easy receipt into the opposite end of frame member 16.

Figure 5:
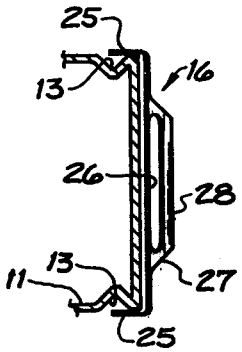
FIG. 5 is an end view of the frame taken along lines 5—5 of FIG. 4.
Figure 7:
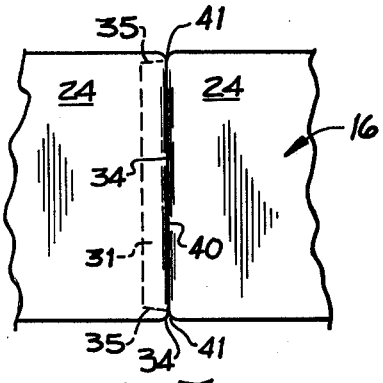
FIG. 7 is a fragmentary bottom view of the frame joint.

Frame member 16 is positioned around the cylindrical tank 11, as seen in FIG. 5, and the flanges 25 on both sides of the frame are deformed inwardly at an angle of approximately 60° into grooves 13 to grip the tank and form a rigid structure. The cloth end panels 22 are also held in place by the flanges 25. The lateral edge 29 of frame 16, has a slight radius or rolled edge 34 along its entire length which can be seen in FIGS. 6 and 7. The rolled edge 34 abutts the root section 33 of the offset portion 31 and the edges 30 of flanges 25 so as to hide any sharp edges. As can be seen in FIG. 7, the other mating lateral edge 29 of frame 16 also has rolled edges 41 on the flanges 25 so that there are no exposed metal edges in joint 40. Lap joint 40 in its joined position provides a very smooth joint without the necessity of deburring the lateral edges.

Support loops 18 are formed with slots 26 having rounded ends 29 so as not to abrade the web support strap 20 which passes therethrough.

Having described the invention with sufficient clarity to enable those familiar with the art to construct and use it, I claim:

1. A canteen construction including a cylindrical tank with a closeable opening therein, a sheet metal circular frame surrounding the circumference of the tank having a lateral joint therein, the circumferential edges of the frame are inwardly formed flanges engaging the edges of the tank;

a plurality of strap support means formed in the frame around its periphery for receiving a carrying strap, each support means includes a pair of closely spaced parallel slots having rounded ends and parallel sides, the area of the frame between said slots being formed upwardly out of the plane of the frame so that at least one side of each slot is outside the plane of the frame and whereby said rounded ends of the slots minimize the abrasive effect on the carrying strap.

2. A canteen construction as set forth in claim 1, wherein the strap support means includes a strengthening rib formed in the frame between the slots.

3. A canteen construction as set forth in claim 1, wherein the strap supporting means are spaced around the periphery of the frame with each supporting means including a strengthening rib formed between the slots with a length approximate that of the slots in the upwardly formed area.

4. A canteen construction as set forth in claim 1, wherein the outer sides of each parallel slot are downwardly formed out of the plane of the frame.

* * * * *